United States Patent [19]

Kriebel

[11] Patent Number: 4,704,349

[45] Date of Patent: Nov. 3, 1987

[54] PROCESS FOR THE PREPARATION OF PHOTOGRAPHIC DIRECT-POSITIVE EMULSIONS

[75] Inventor: Arnd Kriebel, Marly, Switzerland

[73] Assignee: Ciba-Geigy AG, Basel, Switzerland

[21] Appl. No.: 28,020

[22] Filed: Mar. 18, 1987

Related U.S. Application Data

[63] Continuation of Ser. No. 790,908, Oct. 24, 1985, abandoned.

[30] Foreign Application Priority Data

Nov. 2, 1984 [CH] Switzerland ..... 5268/84

[51] Int. Cl.[4] ..... G03C 1/08; G03C 1/485

[52] U.S. Cl. ..... 430/406; 430/603; 430/605; 430/567; 430/569; 430/570; 430/940

[58] Field of Search ..... 430/569, 599, 603, 605, 430/940, 406, 598, 596, 567, 570

[56] References Cited

U.S. PATENT DOCUMENTS

| | | | |
|---|---|---|---|
| 3,850,637 | 11/1974 | Evans | 430/409 |
| 4,183,756 | 1/1980 | Locker | 430/569 |
| 4,431,730 | 2/1984 | Urabe et al. | 430/600 |
| 4,581,328 | 4/1986 | Matsuyama | 430/605 |

*Primary Examiner*—Won H. Louie

*Attorney, Agent, or Firm*—Wenderoth, Lind & Ponack

[57] ABSTRACT

Photographic direct-positive emulsions with silver halide crystals of layered structure are prepared.

The silver halide crystals of these emulsions can form a latent internal image and are superficially converted to silver iodide. Normal surface developers are suitable for developing.

22 Claims, No Drawings

PROCESS FOR THE PREPARATION OF PHOTOGRAPHIC DIRECT-POSITIVE EMULSIONS

This application is a continuation of now abandoned application Ser. No. 790,908, filed Oct. 24, 1985.

The present invention relates to a process for the preparation of photographic direct-positive emulsions.

Photographic direct-positive emulsions based on silver halides have been known for a long time. A review of the known processes for the production of direct-positive silver halide materials is given in T. H. James, The Theory of the Photographic Process, 4th edition, 1977, Macmillan Publishing Co., Inc., Pages 182 to 193. However, only two processes have gained importance in practice, namely the imagewise destruction of fog nuclei on the surface of fogged silver halide crystals by exposure (photohole bleaching or surface fog destruction) and subsequent development or the use of unfogged internal image emulsions which on exposure form a latent image preferably in the crystal interior, with subsequent fogging development in the presence of a so-called nucleating agent (internal image desensitisation).

The first class of direct-positive emulsions is described, for example, in U.S. Pat. Nos. 3,501,305, 3,501,306, 3,501,307, 3,501,309, 3,501,310, 3,531,288, 3,598,596, 3,615,517, 3,697,281 and 4,045,228. However, these emulsions have a number of fundamental disadvantages which substantially restrict their application. The sensitivity of the emulsions depends on the degree of fogging, i.e. on the number and size of the fog nuclei. With increasing degree of fogging, the sensitivity decreases with a rise in maximum density. This leads to instabilities during storage of the materials. To obtain optimum sensitivity, the presence of a high concentration of an electron acceptor (desensitiser) on the crystal surface is necessary in addition. These electron acceptors are generally not diffusion-resistant and thus prevent use of these emulsion types in multi-layer materials, such as are required for colour photography.

The second class of direct-positive emulsions is described, for example, in U.S. Pat. Nos. 3,367,778, 3,761,266, 3,917,485 and 4,395,478, DE-C 3,241,643, 2,402,130, 2,211,769, 2,211,728 and 2,136,081 or in Research Disclosure No. 15,162, volume 151, November 1976 and No. 22,534, January 1983, page 49. Even though these direct-positive emulsions do not have the disadvantages of photohole bleaching and also give a higher sensitivity, fogging development or a homogeneous second exposure are necessary for processing. For this reason, it is not possible to use this type of direct-positive emulsion in multi-layer materials in combination with silver halide negative emulsions which form a latent surface image, such as is required, for example, for masking a silver dye bleach material. The masking of silver dye bleach material is described, for example, in U.S. Pat. No. 4,046,566.

The object of the present invention is therefore the preparation of fast direct-positive emulsions which can be processed without the use of a conventional fogging agent or densensitiser in usual photographic developers and without a homogeneous second exposure.

It has now been found that fast direct-positive emulsions can be obtained when the surface of silver halide crystals of layered crystal structure, the core of which has been chemically sensitised, is chemically sensitised and then converted wholly or partially to silver iodide.

The present invention therefore relates to a process for the preparation of direct-positive emulsions which contain silver halide crystals of layered structure and can produce a latent internal image, which comprises causing a shell of silver halide to grow on chemically sensitised silver halide cores and subjecting the surface of the shell first to a sulphur/gold sensitisation and then to a treatment with iodide ions.

The invention also relates to the direct-positive emulsions prepared by the process according to the invention.

Moreover, the invention also relates to the use of these direct-positive emulsions in photographic recording materials, in particular in photographic elements and film units for chromogenic development, for dye diffusion transfer processes and for the silver dye bleach process.

Silver halide emulsions of a layered crystal structure, which are capable of forming a latent internal image, are used for the preparation of the direct-positive emulsions according to the invention. Such emulsions can be prepared by various known processes. Thus, for example, the preparation of such emulsions is described in U.S. Pat. No. 3,206,313, wherein chemically sensitised silver halide crystals are mixed with smaller silver halide crystals which then grow by Ostwald ripening onto the larger crystals, a shell being formed around the larger crystals (cores). The shell of the crystals can, however, also be obtained by directly precipitating silver halide onto the core, as described, for example, in GB-A No. 1,027,146. The core emulsions used can be the known silver halide emulsion types, such as are described, for example, in Research Disclosure No. 17,643, Section I A to C, December 1978, Research Disclosure No. 22,534, January 1983, or in GB-A Nos. 1,507,989, 1,520,976, 1,596,602 and 1,570,581 or DE-A Nos. 3,241,634, 3,241,638, 3,241,641, 3,241,643, 3,241,645 and 3,241,647.

In a preferred embodiment, the cores have a narrow crystal size distribution, i.e. the coefficient of variation of the crystal size is less than 20%. (The coefficient of variation is defined as 100 times the standard deviation of the crystal diameter, divided by the mean crystal diameter).

The core emulsion is chemically sensitised by known methods, such as are described, for example, in Research Disclosure No. 17,643, Section IIIA, until an optimum ratio of sensitivity and fog has been reached. Preferably, the chemical sensitisation is carried out with the use of sulphur, selenium and/or tellurium compounds or with the use of noble metal compounds as the sensitisers. However, the chemical sensitisation can also be effected with the use of a combination of sulphur, selenium and/or tellurium compounds with noble metal compounds, iridium compounds and especially gold compounds being particularly suitable noble metal compounds. The sensitivity of the core emulsion largely determines the sensitivity of the resulting direct-positive emulsions according to the invention.

The sulphur, selenium and tellurium sensitisers are applied in quantities of about 0.1 to 100 μmol per mol of silver, depending on the crystal type and size, and the noble metal sensitisers are applied in quantities of 0.01 to 200 μmol per mol of silver. Advantageous quantities are also in the range from 0 to 50 μmol of sulphur, selenium and tellurium sensitiser per mol of silver and from 0 to 25 μmol of noble metal sensitiser per mol of silver.

The sensitised core emulsion is then enveloped by further silver halide, preferably by direct precipitation of further silver halide onto the sensitised cores by a controlled double jetting technique. The shell can consist of silver bromide, silver chloride or silver chlorobromide.

The thickness of the shell must be sufficient to protect the sensitisation centres of the core emulsion from the action of the developer. It depends thus on the dissolving power of the developer and on the development conditions, such as development time and temperature. In general, the ratio of the volume of the core and of the volume of the shell is about 1:50 to 5:1.

After the silver halide shell has been produced, the emulsion can be freed from water-soluble salts by means of known washing techniques, such as are described, for example, in Research Disclosure No. 17,643, Section IIA, December 1978.

However, a washing process can also already be applied after the precipitation of the core emulsion, if this is necessary. The emulsions thus obtained are converted by sulphur/gold sensitisation, preferably sulphur/gold sensitisation of the crystal surface, and subsequent treatment with iodide ions into direct-positive emulsions.

The degree of surface sensitisation here depends on a number of parameters, for example on the crystal structure, the crystal size and form, the type of sensitisation of the core, and the like. Preferably, 1 to 50 μmol, in particular 4 to 15 μmol, of a sulphur-sensitiser, for example sodium thiosulphate, and 1 to 100 μmol, in particular 3 to 25 μmol, of a noble metal sensitiser, for example chloroauric acid or gold thiocyanate, are applied. The conditions of surface sensitisation should be selected such that at most 60% of the silver halide are developed when the surface-sensitised emulsion is developed for 4 minutes at 30° C. in a developer of the composition given in Example 1 below.

The conversion, according to the invention, into direct-positive emulsions is effected by treatment of these emulsions with iodide ions. For this purpose, a solution of an alkali metal iodide is added to the emulsions, and these are digested for some time at temperatures between 30° and 80° C. The pAg value is then adjusted by addition of silver nitrate solution to about 8 to 9, preferably 8.5.

The quantity of the iodide added depends on the form and size of the silver halide crystals and on the degree of surface sensitisation. In general, 0.1 to 20 mol %, preferably 0.5 to 10 mol %, of iodide are added, relative to the total silver halide.

During this treatment with iodide ions, the surface of the shell is converted wholly or partially to silver iodide. The iodide treatment and the subsequent pAg correction do not, however, lead to a conversion, destroying the crystal form, of the silver halide crystals.

The emulsions according to the invention, thus prepared, give a direct-positive image of the original after simple, usual exposure and development in conventional photographic developers, without further additives.

The emulsions according to the invention can also be spectrally sensitised, for example for use in colour materials for the red, green or blue spectral region of the visible spectrum. In general, all spectral sensitisers, or combinations thereof, which are suitable for spectrally sensitising negative-working silver halide emulsions, are also suitable for spectrally sensitising the direct-positive emulsions according to the invention. Examples of such sensitising dyes and techniques are to be found in Research Disclosure No. 17,643, Section IV, and especially in Research Disclosure No. 22,534, January 1983, pages 24 to 28.

Preferably, the spectral sensitisation is carried out after the iodide treatment of the crystals. It can also be advantageous, however, to carry out the spectral sensitisation simultaneously with the chemical sensitisation of the crystal shell.

The direct-positive emulsion according to the invention contain a dispersing medium in which the silver halide crystals are dispersed. The dispersing medium of the direct-positive emulsion layers and other layers of the photographic elements can contain various colloids by themselves or in combination as a binder or dispersing agent. Preferred binders and dispersing agents, such as gelatine and gelatine derivatives, are described, for example, in Research Disclosure No. 17,643, Section IX.

The photographic elements and film units produced with the direct-positive emulsions according to the invention can be hardened by means of known hardeners, for example those known from Research Disclosure No. 17,643, Section X, in order to allow processing at elevated temperatures.

For protection from instabilities which might alter the properties of the direct-positive materials, stabilisers, antifogging agents, agents for improving the pressure stability, stabilisers for latent images and similar additives, such as are usually employed for the production of photographic emulsions, can be added. Additives of this type are known, for example, from Research Disclosure No. 17,643, December 1978, Section VI. Many antifogging agents which are effective in emulsions can also be used in developers. Antifogging agents of this type are described in more detail, for example, in C. E. K. Mees, The Theory of the Photographic Process, 2nd edition, published by Macmillan, 1954, pages 677–680.

In some cases, advantageous results can be obtained when the direct-positive materials according to the invention are developed in the presence of certain antifogging agents, such as are described, for example, in U.S. Pat. No. 2,497,917.

Advantageous results can also be obtained when the direct-positive materials are developed in the presence of comparatively high concentrations of the abovementioned antifogging agents of for example up to 5, preferably 1 to 3 g per liter of developer solution, or when these compounds are incorporated in the photographic recording materials, for example in concentrations of up to 1000, preferably from 100 to 500, mg per mol of silver.

Apart from the additives mentioned, a large number of other conventional photographic additives can be used in the direct-positive emulsions according to the invention. Such additives are described in more detail, for example, in Research Disclosure No. 17,643, December 1978, in Sections V, VIII, XI–XIV, XVI, XX and XXI.

To obtain a wider exposure latitude, direct-positive emulsions according to the invention of different speeds can be mixed with one another.

To meet special requirements, the emulsions according to the invention can also be mixed or combined with conventional negative emulsions which form a surface image. The latter is important especially for the masking of silver dye bleach materials. This is demonstrated in Example 11 below.

In the simplest form, a recording material according to the invention contains one direct-positive emulsion layer.

The recording materials can, however, also contain more than only one direct-positive emulsion layer, and also top layers, adhesive layers and interlayers, such as are present in conventional photographic recording materials. Instead of mixing emulsions with one another as described above, the same effect can frequently also be obtained by applying the emulsions in the form of separate layers. Thus, the use of separate emulsion layers for obtaining an advantageous exposure latitude is known, for example, from Zelikman and Levi, Making and Coating Photographic Emulsions, Focal Press, 1964, pages 234–238 and GB-B No. 923,045.

Furthermore, it is known that improved photographic speed can be obtained when comparatively fast and comparatively slower direct-positive emulsions are applied in separate layers to a base, instead of mixing them. Preferably, the faster emulsion layer is nearer to the light source than the slower emulsion layer. Instead of using two emulsion layers, three or even more emulsion layers can also be arranged on top of each other.

In the production of the direct-positive recording materials according to the invention, the most diverse conventional bases can be used. These include bases of polymeric films, wood fibres, paper for example, metal foils, glass bases and bases of ceramic materials, if appropriate provided with one or more adhesive layers, in order to improve the adhesive and antistatic properties, the dimensional properties, antihalation properties and/or other properties of the base surface. Such bases are known, for example, from Research Disclosure No. 17,643, December 1978, Section XVII.

The direct-positive recording materials according to the invention can be exposed by conventional methods, for example as described in Research Disclosure No. 17,643, Section XVIII. The advantages obtainable according to the invention manifest themselves especially when imagewise exposure is carried out with electromagnetic radiation of that region of the spectrum in which the spectral sensitisers present have absorption maxima. If the photographic recording materials are intended to record in the blue, green, red or infrared region, a spectral sensitiser absorbing in the blue, green, red or infrared region of the spectrum is present. In the case of black-and-white recording materials, it has proved to be advantageous when the recording materials are orthochromatically or panchromatically sensitized, in order to shift the sensitivity region into the visible spectrum. The radiation used for exposure can either be noncoherent (random phase) or coherent (in phase, generated by lasers). Furthermore, the recording materials can be exposed imagewise at normal, elevated or reduced temperatures and/or pressures with light sources of the most diverse intensities. This can be done continuously or intermittently. Depending on the intensity, the exposure times can be from minutes down to microseconds, and they can be determined by conventional known sensitometric methods, as described in more detail, for example, by T. H. James in The Theory of the Photographic Process, 4th edition, published by Macmillan, 1977, Chapters 4, 6, 17, 18 and 23.

After the exposure, the light-sensitive silver halide of the recording materials can be developed in the conventional manner to visible images by contacting the silver halide with an aqueous alkaline medium which contains a developer compound.

The developers used for developing the silver halide are surface developers. The term "surface developer" here comprises those developers which uncover latent surface image centres on a silver halide grain but, under the conditions generally applied for developing a surface-sensitive silver halide emulsion, do not uncover any essentially latent internal image centres in an emulsion giving latent internal images. Quite generally, the conventional silver halide developer compounds or reducing agents can be used in the surface developers, but the developer bath or developer composition is in general essentially free of a silver halide solvent, for example water-soluble thiocyanates, water-soluble thioethers, thiosulphates and ammonia, which break up or dissolve the silver halide grain, uncovering the internal image. Occasionally, comparatively small amounts of halide ions in the developer are desirable or are incorporated into the emulsion as halide-releasing compounds, but high concentrations of iodide or iodide-releasing compounds are avoided, in order to prevent breaking-up of the grain.

Examples of typical silver halide developer compounds which can be used in the developers are hydroquinones, pyrocatechols, aminophenols, 3-pyrazolidones, ascorbic acid and its derivatives, reductones, phenylenediamines or combinations thereof. The developer compounds can be incorporated in the recording materials themselves, being contacted with the silver halide after imagewise exposure. In certain cases, however, they are preferably used in a developer solution or a developer bath.

The development is preferably carried out at elevated temperatures, for example between 30° and 60° C.

Photographic direct-positive materials as well as elements and film units, which contain the direct-positive emulsions according to the invention, can be used in a known manner for the production of colour images by selective destruction or formation of dyes, for example for image generation by chromogenic development or by the silver dye bleach process. These processes are described in T. H. James, The Theory of the Photographic Process, 1977, pages 335 to 372.

The direct-positive emulsions according to the invention can also be used for photographic diffusion transfer processes, as described, for example, in Research Disclosure No. 15,162, November 1976.

The direct-positive emulsions according to the invention are distinguished by simplicity of production, high speed and universal applicability. They show no tendency to re-reversal, i.e. formation of a negative image on over-exposure, and have good storage stability.

The examples which follow illustrate the invention.

EXAMPLE 1

A silver bromide emulsion containing monodisperse cubic crystals of 0.23 μm edge length is prepared by the controlled double-jetting technique, 685 ml each of 4-molar potassium bromide solution and silver nitrate solution being added at pAg 5.9 to 65° C. to a solution of 32 g of gelatine in 650 ml of water.

This core emulsion is subjected to a sulphur/gold sensitisation. For this purpose, the pAg value is adjusted to 8.5 at 40° C. and the emulsion is digested for 20 minutes at 65° C. with, per mol of silver bromide, 18 μmol of sodium thiosulphate and 11 μmol of chloroauric acid.

An octahedral silver bromide shell is then caused to grown onto the chemically sensitised core emulsion. After the addition of 665 g of a 20% gelatine solution, this is effected by controlled, simultaneous addition of 2,140 ml each of 4-molar potassium bromide solution and silver nitrate solution at pAg 9.0.

This gives octahedral crystals of a volume-equivalent cube edge length of 0.38 μm.

This emulsion is flocculated in the conventional manner, in order to remove soluble salts, and redispersed in gelatine solution such that an emulsion is formed which contains 50 g of gelatine and 1 mol of AgBr per kg.

This emulsion is once more chemically sensitised. The pH value is adjusted to 6.5 and the pAg value is adjusted to 8.5 at 40° C., 12 μmol of sodium thiosulphate and 8 μmol of chloroauric acid are added per mole of silver bromide, and the emulsion is heated to 65° C. and digested for 40 minutes.

After usual exposure and development, this emulsion would give a very weak, insensitive photographic negative image.

The conversion of this emulsion into a direct positive emulsion is carried out according to the invention by simple digestion with potassium iodide. 1 kg of emulsion is treated with 810 ml of an aqueous 0.1M potassium iodide solution (this corresponds to an iodide quantity of 8.1 mol %, relative to the silver quantity) and digested for 5 minutes at 40° C., and the pAg value is then adjusted to 8.5 by addition of 1M silver nitrate solution.

This emulsion is coated onto a polyester film with 2 g/m² of silver, 7.5 g/m² of gelatine and 85 mg/m² of 1-amino-3-hydroxy-5-methylmorpholinium-triazine tetrafluorborate as a hardener. The dried layer is exposed in the conventional manner behind a stepwedge and developed for 4 minutes at 30° C. in a developer of the following composition:

Developer bath: Sodium ethylenediamine

| | |
|---|---|
| tetraacetate | 2.0 g |
| Potassium bromide | 2.0 g |
| Ethyl cellosolve | 60.0 g |
| Phenidone Z | 3.0 g |
| Hydroquinone | 15.0 g |
| Benzotriazole | 0.8 g |
| Boric acid | 16.0 g |
| Ascorbic acid | 10.0 g |
| Potassium hydroxide | 26.0 g |
| Potassium metabisulphite | 26.0 g |
| Water to make up to | 1000 ml |

After developing, the material is fixed, washed and dried in the usual way. This gives a positive image of the exposed stepwedge with the following sensitometric values:

| Maximum density | Minimum density | log. rel.S at 0.5 × $D_{max}$ |
|---|---|---|
| 0.79 | 0.12 | 1.85 |

EXAMPLE 2

This example shows that a higher sensitivity can be achieved with larger crystals.

Analogously to Example 1, a monodisperse, cubic silver bromide emulsion with a mean edge length of 0.5 μm is first prepared. This emulsion is ripened for 20 minutes at 65° C. with 8 μmol of sodium thiosulphate and 5 μmol of chloroauric acid per mol of silver halide and then surrounded by an octahedral silver bromide shell, until crystals of a volume-equivalent cube edge length of 0.74 μm are formed. The emulsion is then flocculated, washed and redispersed in gelatine solution. After the addition of 5.4 μmol of sodium thiosulphate and 3.5 μmol of chloroauric acid per mol of AgBr, ripening is continued at pAg 8.5 for a further 40 minutes at 65° C.

360 ml of a 0.2 molar potassium iodide solution are added to 1 kg of emulsion (containing 1 mol of AgBr), and the emulsion is then digested for 5 minutes at 40° C. and the pAg value is then adjusted to 8.5

For sensitometric testing, the procedure of Example 1 is followed, giving a direct-positive image with the following sensitometric values:

| Maximum density | Minimum density | log. rel.S at 0.5 × $D_{max}$ |
|---|---|---|
| 0.76 | 0.06 | 0.76 |

The emulsion from Example 2 is thus more sensitive than the emulsion from Example 1 by 1.09 log units or a factor of 12.

EXAMPLE 3

This example shows the preparation of direct-positive emulsions with crystals having cubic boundary surfaces.

A cubic silver bromide shell is precipitated onto the core emulsion (sulphur/gold sensitised, cubic silver bromide crystals of 0.23 μm edge length) described in Example 1. For this purpose, 4-molar solutions of silver nitrate and potassium bromide are added at 65° C., pAg 5.9 and pH 5.1, until the crystals have reached an edge length of 0.75 μm.

The emulsion is flocculated and redispersed in gelatine solution, so that an emulsion is formed which contains 1 mol of AgBr and 50 g of gelatine per kg.

For the surface sensitisation, the pH is adjusted to 6.5 and the pAg is adjusted to 8.5 at 40° C. 5.5 μmol of sodium thiosulphate and 4.25 μmol of chloroauric acid are then added per mol of silver bromide, and the emulsion is digested for 40 minutes at 65° C.

1000 g of emulsion are then diluted with 3500 g of a 9.3% gelatine solution and 55 ml of a 0.1 molar potassium iodide solution are added. The mixture is then digested for 5 minutes at 40° C., and the pAg value is adjusted to 8.5 and the pH value is adjusted to 6.5. The emulsion is coated with an applied amount of 2 g of silver per m² onto a transparent polyester base and, as described in Example 1, exposed and processed. This gives a positive image with the following sensitometric data:

| Maximum density | Minimum density | log. rel.S at 0.5 × $D_{max}$ |
|---|---|---|
| 0.95 | 0.07 | 1.5 |

EXAMPLE 4

This example shows that polydisperse, octahedral silver halide crystals can also be used for the preparation of direct-positive emulsions.

574 ml of a 4-molar potassium bromide solution are added to a solution of 31.4 g of gelatine in 3230 ml of water. The solution is heated to 60° C. and a solution of 463.6 g of silver nitrate in 1764 ml of water is added within 30 seconds, with good stirring. A further 309 g of silver nitrate, dissolved in 1168 ml of water, are then added within 20 minutes. This gives polydisperse twin crystals with octahedral boundary surfaces and a mean volume-equivalent cube edge length of 0.32 μm.

The emulsion is then flocculated and redispersed, as described in Example 1. The redispersed emulsion is sensitised at pH 6.3 and pAg 8.5 for 60 minutes at 65° C. with 44 μmol of sodium thiosulphate and 25 μmol of chloroauric acid. A silver bromide shell is then precipitated onto the crystals at 65° C. and pAg 9.0. This is carried out by controlled double jetting of 550 ml each of 4-molar solutions of silver nitrate and potassium bromide, while avoiding renucleation.

This gives silver bromide crystals of a volume-equivalent cube edge length of 0.48 μm.

The emulsion is flocculated, redispersed and chemically sensitised a second time by adding 5.4 μmol of sodium thiosulphate and 25 μmol of chloroauric acid per mol of silver bromide and ripening for 30 minutes at 65° C. and pAg 8.5.

2500 ml of a 10.2% gelatine solution and 400 ml of a 0.1 molar potassium iodide solution (this corresponds to 4 mol % of the silver bromide) are then added. The mixture is digested for 15 minutes at 40° C., and the pAg value is adjusted to 8.5 and the pH value to 6.5. The emulsion is coated onto a transparent polyester base (2 g of silver applied per $m^2$), and exposed and processed as in Example 1. This gives a direct-positive image with the following sensitometric data:

| Maximum density | Minimum density | log. rel.S at 0.5 × $D_{max}$ |
|---|---|---|
| 0.88 | 0.18 | 1.86 |

EXAMPLE 5

This example shows the influence of the type of chemical sensitisation of the crystal surface and of the subsequent treatment with iodide ions.

A silver bromide emulsion with a chemically sensitised core and a shell grown thereon is prepared as described in Example 2. However, the surface sensitisation of the octahedral shell is carried out with only 3.7 μmol of sodium thiosulphate per mol of silver bromide. This emulsion is divided into three parts A, B and C, which are then digested with different quantities of potassium iodide (Table 1). The three emulsions are then coated, exposed and processed as indicated in Example 2.

The sensitometric results are given in Table 1.

TABLE 1

| Emulsion | KI addition (mol %) | Maximum density | Minimum density |
|---|---|---|---|
| A | 0 | 0.053 | 0.035 |

TABLE 1-continued

| Emulsion | KI addition (mol %) | Maximum density | Minimum density |
|---|---|---|---|
| B | 0.6 | 0.079 | 0.039 |
| C | 3.6 | 0.079 | 0.044 |

It is seen that a pure sulphur sensitisation of the crystal surface, independently of the iodide treatment, gives virtually no maximum density and hence no direct-positive image.

EXAMPLE 6

This example shows the influence of the iodide digestion of the maximum density of the direct-positive image.

Three emulsions D, E and F are prepared, as described in Example 2. The three emulsions differ only in the quantity of iodide which is added for the final digestion. The quantities of iodide and the sensitometric results are given in Table 2. They show clearly that no direct-positive image is obtained without iodide digestion (emulsion F) and that the maximum density of the direct-positive image can be increased by higher iodide quantities.

TABLE 2

| Emulsion | KI addition (mol %) | Maximum density | Minimum density | rel. log sensitivity at 0.5 × $D_{max}$ |
|---|---|---|---|---|
| D | 3.6 | 0.76 | 0.06 | 0.76 |
| E | 0.6 | 0.18 | 0.04 | 0.66 |
| F | 0 | 0.09 | 0.05 | (no image) |

EXAMPLE 7

This example shows that the direct-positive emulsions according to the invention can also be spectrally sensitised. Three parts G, H and I of the emulsion described in Example 2 are spectrally sensitised with different quantities of the green sensitiser of the formula

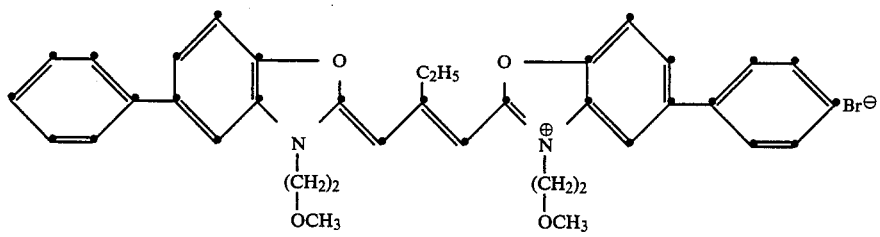

(100)

The three emulsions are coated, at 0.3 g of silver applied per $m^2$, to a polyethylene-coated paper base, exposed once behind a green filter and once behind a blue filter and processed as indicated in Example 1.

The sensitometric results are given in Table 3.

TABLE 3

| Emulsion | mg of sensitiser per mol of AgBr | rel. log.S for green light | rel. log.S for blue light |
|---|---|---|---|
| G | 0 | 3.1 | 0.9 |
| H | 72 | 1.0 | 0.6 |
| I | 144 | 0.8 | 0.75 |

EXAMPLE 8

1000 ml each of 4M silver nitrate and 4M potassium bromide solution are allowed to run within 30 minutes at 40° C. into a solution of 60 g of gelatine, 32 g of ammonium nitrate and 50 ml of 4M sodium hydroxide solution in 1875 ml of water, the pAg value being kept constant at 8.5. The 4M potassium bromide solution additionally also contains 32 g of ammonium nitrate and 50 ml of 4 M sodium hydroxide solution per 1 liter of solution. This gives cubic silver bromide crystals of a mean edge length of 0.47 μm. The emulsion is flocculated, washed and redispersed in such a way that 1 kg of the redispersed emulsion contains 1 mol of silver and 5% of gelatine. This emulsion is divided into 4 parts K, L, M and N and chemically sensitised as follows at 65° C., pH 6.0 and pAg 8.5:

TABLE 4

| Emulsion | Sensitisor [μ mol/mol Ag] | rel. log.S at $0.5 \times D_{max}$(*) |
|---|---|---|
| K | 45 $Na_2S_2O_3$ | 0.45 |
| L | 45 $Na_2S_2O_3$ + 5 $HAuCl_4$ | −0.09 |
| M | 22.5 $(NH_4)_2IrCl_6$ | 0.89 |
| N | 45 $Na_2S_2O_3$ + 22.5 $(NH_4)_2IrCl_6$ | 0.53 |

(*)These values were measured on emulsion samples which were, in the usual way, coated on a base, exposed and processed as indicated in Example 1.

Octahedral shells are caused to grow on the cores K to N at 65° C., pAg 9.0 and pH 5.6 by the controlled double-jetting technique, until octahedra with a volume-equivalent cube edge length of 0.71 μm have formed.

The four emulsions are once more flocculated, washed and redispersed, and then chemically sensitised in the same way (4.5 μmol of $Na_2S_2O_3$ and 20 μmol of $HAuCl_4$ per mol of silver at 65° C., pH=6.3, pAg=8.5).

56 ml of 1M potassium iodide solution are added to 1000 g of each emulsion (containing 1 mol of silver halide) and the mixtures are digested for 5 minutes at 40° C. The pAg value is then adjusted to 8.5 by addition of 1M silver nitrate solution.

The emulsions are coated in the known manner onto a transparent base and processed as indicated in Example 1. This gives positive images of the exposure wedge, and the sensitometric results are given in Table 5 which follows:

TABLE 5

| Emulsion | $D_{max}$ | $D_{min}$ | rel. log. sensitivity at $0.5 \times D_{max}$ |
|---|---|---|---|
| K | 0.40 | 0.07 | 1.34 |
| L | 0.25 | 0.05 | 0.67 |
| M | 0.37 | 0.06 | 1.98 |
| N | 0.28 | 0.05 | 1.15 |

A comparison of the sensitivities in Tables 4 and 5 shows that the sensitivities of the direct-positive emulsions in Table 5 are the higher, the greater the (negative) sensitivities of the core emulsions (Table 4).

EXAMPLE 9

A shell of 90 mol % of silver bromide and 10 mol % of silver chloride is caused to grow onto the chemically sensitised core emulsion L (0.47 μm cubes), as described in Example 8, at a constant pAg value of 5.9 by the controlled double-jetting technique, until the cubic crystals have reached a mean edge length of 0.67 μm. The emulsion is then flocculated and redispersed in the usual way, and chemically sensitised with 4.8 μmol of sodium thiosulphate and 2.3 μmol of chloroauric acid at pAg 8.5 and pH 6.3 (120 minutes at 60° C.). The emulsion thus sensitised is digested for a few minutes at 40° C. with 26 ml of 1-molar potassium iodide solution per mol of silver halide and the pAg value is then adjusted to 8.5. The emulsion is then coated onto a transparent base with 1 g of silver applied per $m^2$ and processed as described in Example 1. This gives the following sensitometric values:

| $D_{max}$ | $D_{min}$ | log. rel. S at $0.5 \times D_{max}$ |
|---|---|---|
| 0.70 | 0.01 | 0.9 |

EXAMPLE 10

1000 g of the emulsion L as described in Example 8 and containing 1 mol of silver bromide are digested for 5 minutes at 40° C. with 20 ml of 1-molar potassium iodide solution, and the pAg value is then adjusted to 8.5 and the pH value to 6.3. This is followed by spectral sensitisation with 270 mg of the red sensitiser of the formula (101)

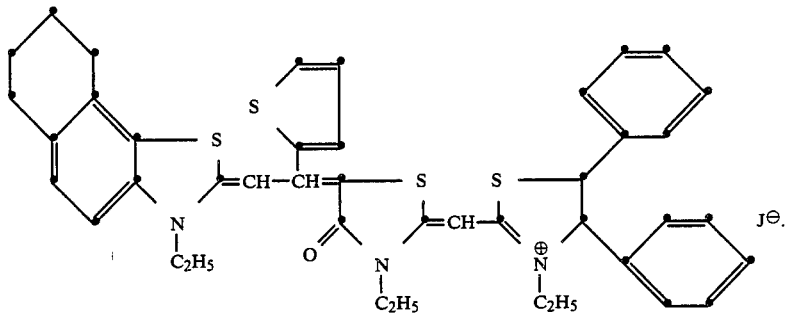

The emulsion is coated in the usual manner, together with the cyan dye of the formula

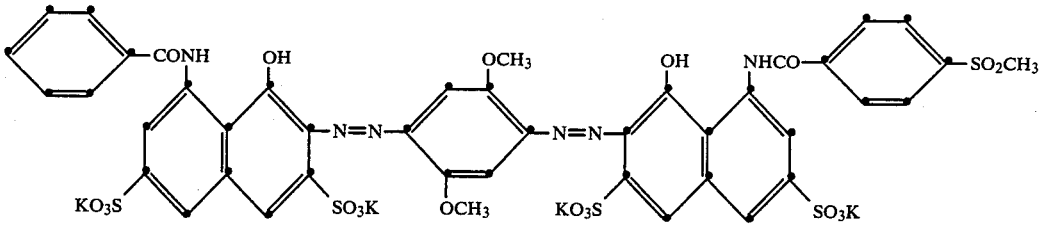

(102)

onto a transparent base, in such a way that 1 $m^2$ of the layer contains 625 mg of silver, 175 mg of the dye of the formula (102) and 40 mg of 1-amino-3-hydroxy-5-methylmorpholinium-triazine tetrafluoborate. The layer is exposed with red light behind a stepwedge and treated at 30° C. as follows:

| | | |
|---|---|---|
| 1. Developing | 1 minute | Bath 1 |
| 2. Washing | 1 minute | |
| 3. Bleaching | 1 minute | Bath 2 |
| 4. Washing | 1 minute | |
| 5. Fixing | 1 minute | Bath 3 |
| 6. Washing | 1 minute | |

The baths have the following compositions:

| | |
|---|---|
| Bath 1: Developer | |
| Sodium ethylenediaminetetraacetate | 2.0 g |
| Potassium sulphite | 37.0 g |
| Sodium sulphite | 15.0 g |
| 1-Phenyl-4-methylpyrazolidone | 3.0 g |
| Hydroquinone | 15.0 g |
| Potassium metaborate | 11.0 g |
| Boric acid | 7.7 g |
| Ascorbic acid | 12.3 g |
| Potassium bromide | 2.0 g |
| Benzotriazole | 0.9 g |
| Ethyl cellosolve | 57.0 g |
| Water to make up to | 1000 ml |
| Bath 2: Bleaching bath | |
| Na m-nitrobenzenesulphonate | 8.0 g |
| Sulphuric acid (100%) | 50.0 g |
| Acetic acid (100%) | 21.0 g |
| 2,3,6-Trimethylquinoxaline | 1.5 g |
| Potassium iodide | 15.0 g |

-continued

| | |
|---|---|
| 4-Mercaptobutyric acid | 1.8 g |
| Water to make up to | 1000 ml |
| Bath 3: Fixing bath | |
| Ammonium thiosulphate | 200.0 g |
| Ammonium sulphite | 17.9 g |
| Ammonium bisulphite | 17.9 g |
| Water to make up to | 1000 ml |

This gives a cyan negative image of the exposed stepwedge with a maximum density of 1.33, a minimum density of 0.04 and a log relative sensitivity of 2.22 at 50% of maximum density.

EXAMPLE 11

The following layers are applied to a white-opaque base, in the order given:

1. a layer which contains 1.77 g/$m^2$ of gelatine, 0.13 g/$m^2$ of the cyan dye of the formula (102) and 0.18 g/$m^2$ of silver as a red-sensitive silver bromoiodide emulsion;
2. an interlayer of 1.5 g/$m^2$ of gelatine;
3. a layer which contains 2.5 g/$m^2$ of gelatine, 0.154 g/$m^2$ of the magenta dye of the formula

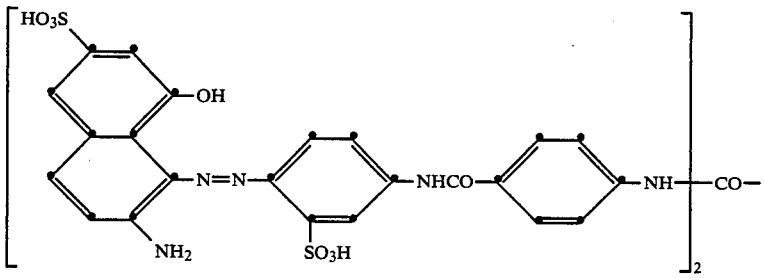

(103)

and 0.23 g/$m^2$ of silver as a green-sensitive silver bromoiodide emulsion;

4. an interlayer or masking layer which contains 1.7 g/$m^2$ of gelatine, 0.12 g/$m^2$ of the yellow dye of the formula

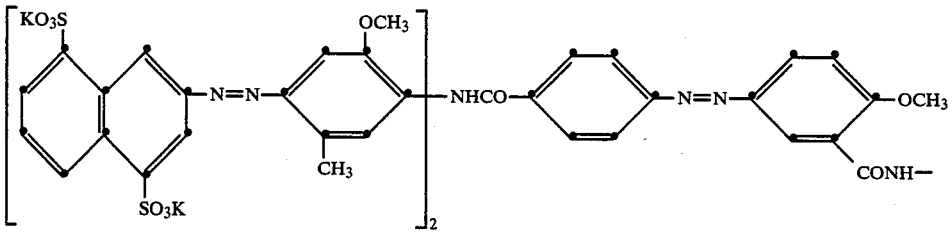

(104)

and 0.45 g/$m^2$ of silver as a direct-positive emulsion as described in Example 10. The direct-positive emulsion is sensitised with 250 mg of the green sensitiser of the formula (105)

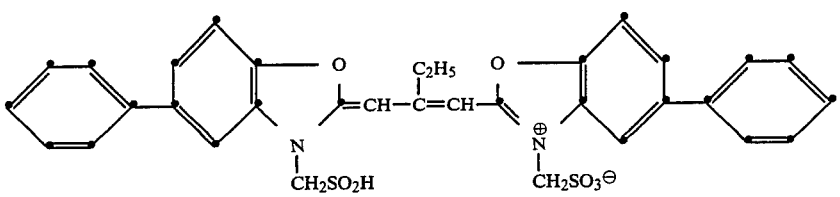

per mol of silver;

5. a layer which contains 1.63 g/m$^2$ of gelatine, 0.08 g/m$^2$ of the yellow dye of the formula (104) and 0.26 g of silver as a blue-sensitive silver bromide emulsion; and 6. a protective layer of 1.5 g/m$^2$ of gelatine.

In addition, the material contains 0.19 g/m$^2$ of 2-amino-4-hydroxy-6-(4-methylmorpholinium)-1,3,5-triazine tetrafluoborate as a hardener.

For comparison, an unmasked material is prepared which, instead of the masking layer 4, only contains a yellow filter layer of 1.7 g/m$^2$ of gelatine, 0.054 g/m$^2$ of the yellow dye of the formula (104) and 0.04 g/m$^2$ of colloidal silver.

Grey wedges of both materials are produced by corresponding exposure with red, green and blue light and subsequent processing as described in Example 10. By exposure with blue light, wedges are produced in the same way, the colour of which ranges from blue to black (blue wedge). The analytical colour densities of the yellow dye layer and the corresponding sensitivities are calculated from the measured colour densities of the grey and blue wedges. This gives the following values:

log rel.S of the yellow layer in the grey wedge: 2.15 in the blue wedge: 1.93 difference: 0.22

The comparative material without a masking layer shows a log rel.S of the yellow layer in the grey wedge: 2.20 in the blue wedge: 2.28 difference: −0.08.

The masking effect is clearly demonstrated by the sensitivity difference of the yellow layer between the grey wedge and the blue wedge.

EXAMPLE 12

A direct-positive emulsion is prepared as described in Example 10. The emulsion is spectrally sensitised with 250 mg of the green sensitiser of the formula (105) per mol of silver halide. Together with an emulsion of the colour coupler of the formula (106)

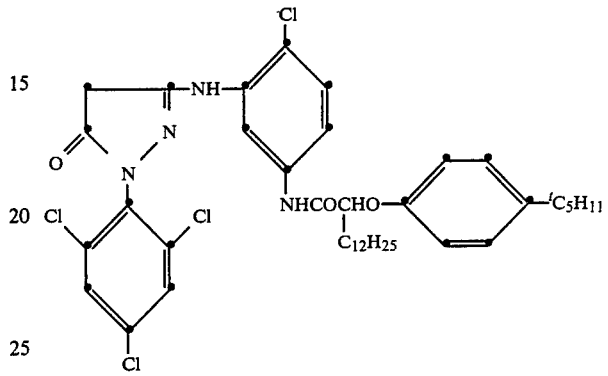

the direct-positive emulsion is coated onto a polyethylene-coated paper base, in such a way that 520 mg of silver, 390 mg of colour coupler and 2 g of gelatine are present per m$^2$ of base area. On top, a protective gelatine layer is coated, which contains 1.5 g/m$^2$ of gelatine and 0.06 g/m$^2$ of 2-amino-4-hydroxy-6-(4-methylmorpholinium)-1,3,5-triazine tetrafluoborate.

The material is exposed in the usual way and processed as follows at 32.8° C.:

| | |
|---|---|
| 1. Developer bath | 3.5 minutes |
| 2. Bleach-fixing bath | 1.5 minutes |
| 3. Washing | 3.0 minutes |
| 4. Drying | 1.0 minute |

The developer bath has the following composition:

| | |
|---|---|
| 4-Amino-3-methyl-N—ethyl-N—[β-(methylsulphonamido)-ethyl]-aniline.1½$H_2SO_4.H_2O$ | 4.85 g/l |
| Potassium bromide | 0.6 |
| Potassium carbonate | 32.0 |
| Lithium sulphate | 1.8 |
| Potassium sulphite | 2.0 |
| Hydroxylamine sulphite | 3.9 |
| Ethylene glycol | 21.3 |
| Benzyl alcohol | 15.1 |
| Water to make up to | 1000 ml |

The pH value is 10.1.

The bleach-fixing bath is a bath having the following composition:

| | |
|---|---|
| Ammonium thiosulphate (80% solution) | 200 g/l |
| Sodium sulphite (anhydrous) | 15 |
| Sodium carbonate (anhydrous) | 2.5 |
| Sodium ethylenediaminetetraacetate | 2 |
| Sodium iron (III) ethylenediamine tetraacetate | 50 |
| Water to make up to | 1000 ml |

After washing and drying, this gives a positive magenta image of the exposed step wedge.

EXAMPLE 13

A material for the dye diffusion transfer process is prepared. For this purpose, the following layers are applied to a transparent base:

1. A receiving layer which contains, as a mordant, 1.5 g/m$^2$ of a copolymer of 50 parts of styrene and 50 parts of butyl acrylate, and 4 g/m$^2$ of gelatine;

2. a white opaque layer which contains 3 g/m$^2$ of gelatine and 23 g/m$^2$ of titanium dioxide;

3. a layer which contains 3.0 g/m$^2$ of gelatine and 0.1 g/m$^2$ of an azo dye of the formula

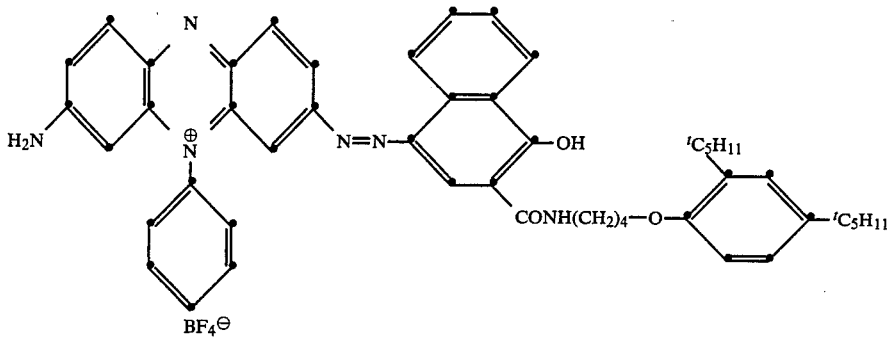

4. an emulsion layer with 2.0 g/m$^2$ of gelatine and 1.5 g/m$^2$ of silver as a green-sensitised direct-positive emulsion, as used in Example 11; and 5. a protective layer which contains 1.5 g/m$^2$ of gelatine and 0.15 g/m$^2$ of 2-amino-4-hydroxy-6-(4-methylmorpholinium)-1,3,5-triazine tetrafluoborate.

After exposure, the material is processed for 3 minutes at 20° C. in the developer bath and for 3 minutes in the bleaching bath, as described in Example 10, and then washed for 1 minute in water.

This gives a positive magenta image, which can be viewed through the transparent base, of the exposed wedge in the receiving layer.

What is claimed is:

1. A process for the preparation of photographic direct-positive emulsions which contain silver halide crystals of layered structure and can produce a latent internal image, which comprises causing a shell of silver halide to grow on chemically sensitised silver halide cores and subjecting the surface of the shell first to a sulphur/gold sensitisation and then to a digestion with a solution of an alkali metal iodide which contains 0.1 to 20 mol % of alkali metal iodide, relative to the silver halide, to at least partially convert the surface of the shell to silver iodide in an amount sufficient to avoid the necessity for using a fogging agent or a second exposure to develop a photographic material comprising the direct-positive emulsion.

2. In a photographic material containing at least one direct-positive emulsion, the improvement wherein the direct-positive emulsion is as defined in claim 1.

3. A process for the production of photographic direct-positive images, which comprises exposing and developing the photographic material of claim 2.

4. A process according to claim 1, wherein a silver halide core emulsion is used in which the coefficient of variation of the crystal size of the silver halide cores is less than 20%.

5. A process according to claim 1, wherein the chemical sensitisation of the silver halide cores is carried out with sulphur, selenium and/or tellurium compounds or with nobel metal compounds.

6. A process according to claim 1, wherein the chemical sensitisation of the silver halide cores is carried out with sulphur, selenium and/or tellurium compounds in combination with noble metal compounds.

7. A process according to claim 5, wherein the noble metal compounds are gold or iridium compounds.

8. A process according to claim 6, wherein the noble metal compounds are gold or iridium compounds.

9. A process according to claim 5, wherein 0 to 50 μmol of sulfphur, selenium and/or tellurium compound and 0 to 25 μmol of noble metal compounds per mol of silver are used for chemical sensitisation.

10. A process according to claim 6, wherein 0 to 50 μmol of sulphur, selenium and/or tellurium compound and 0 to 25 μmol of noble metal compounds per mol of silver are used for chemical sensitisation.

11. A process according to claim 5, wherein 0.1 to 100 μmol of sulphur, selenium and/or tellurium compound and 0.01 to 200 μmol of noble metal compound per mol of silver are used for the chemical sensitisation.

12. A process according to claim 6, wherein 0.1 to 100 μmol of sulphur, selenium and/or tellurium compound and 0.01 to 200 μmol of noble metal compound per mol of silver are used for the chemical sensitisation.

13. A process according to claim 1, wherein the chemically sensitised silver halide cores are coated with a shell of silver bromide, silver chloride or silver chlorobromide.

14. A process according to claim 13, wherein the silver halide cores are coated with such a quantity of silver halide shell that the ratio of the volume of the silver halide cores and of the volume of the shell is 1:50 to 5:1.

15. A process according to claim 1, wherein the shell is chemically sensitised with sodium thiosulphate in combination with gold thiocyanate or chloroauric acid.

16. A process according to claim 1, wherein 1 to 50 μmol of sulphur sensitiser and 1 to 100 μmol of noble metal sensitiser are used per mol of silver.

17. A process according to claim 16, wherein 4 to 15 μmol of sulphur sensitiser and 3 to 25 μmol of noble metal sensitiser are used per mol of silver.

18. A process according to claim 1, wherein the digestion is carried out with a solution which contains 0.5 to 10 mol % of alkali metal iodide, relative to silver halide.

19. A process according to claim 1, wherein the pAg value is adjusted to 8–9 after the treatment of the shell with a solution of an alkali metal iodide.

20. A process according to claim 1, wherein spectral sensitisation is effected simultaneously with the sulphur/gold sensitisation of the shell.

21. A process according to claim 1, wherein the shell treated with iodide ions is spectrally sensitised.

22. A direct-positive emulsion obtained by the process according to claim 1.

* * * * *